United States Patent [19]

Friesen

[11] Patent Number: 4,863,178

[45] Date of Patent: Sep. 5, 1989

[54] MOVEABLE SUPPORT FRAME

[76] Inventor: Ronald Friesen, Box 356, Virgil, Ontario, Canada, L0S 1T0

[21] Appl. No.: 98,166

[22] Filed: Sep. 18, 1987

[51] Int. Cl.[4] ..... B25H 5/00

[52] U.S. Cl. ..... 280/32.6; 182/116; 297/195

[58] Field of Search ..... 280/32.6, 32.5, 87.04 R, 280/79.1 R, 79.2; 297/195; 108/11, 106; 182/116, 129; 248/295.1

[56] References Cited

U.S. PATENT DOCUMENTS

| | | | |
|---|---|---|---|
| 2,109,886 | 3/1938 | Lewis | 182/129 |
| 2,132,331 | 10/1938 | Wanamaker | 182/129 |
| 2,208,472 | 7/1940 | Richardson | 182/116 |
| 2,636,705 | 4/1953 | Stanton | 280/32.6 |
| 2,643,045 | 6/1953 | Renfro | 182/129 |
| 2,701,168 | 2/1955 | Schemers | 182/116 |
| 2,969,123 | 1/1961 | Jamerson et al. | 182/116 |
| 2,970,668 | 2/1961 | Snyder | 182/116 |
| 3,477,673 | 11/1969 | Bereday | 297/195 |
| 4,072,209 | 2/1978 | Bolis | 182/116 |
| 4,530,419 | 7/1985 | Rumage et al. | 280/32.5 |
| 4,542,806 | 9/1985 | Olson | 182/116 |
| 4,632,410 | 12/1986 | Bainbridge et al. | 280/32.5 |

FOREIGN PATENT DOCUMENTS

| | | | |
|---|---|---|---|
| 924065 | 4/1963 | United Kingdom | 280/79.2 |

*Primary Examiner*—Charles A. Marmor
*Assistant Examiner*—Tamara L. Finlay
*Attorney, Agent, or Firm*—Rogers, Bereskin & Parr

[57] ABSTRACT

This invention relates to a moveable support frame for supporting a person, such as a mechanic, who may be working on cars, trucks and the like. the invention provides a moveable support having four ground engaging wheels, which support two opposed longitudinal members. At least one cross member is affixed between the opposed longitudinal members. The cross member has a number of spaced locking passageways therein. An upright support post assembly is also provided, which is supported by the cross member. The support post assembly is releasably secured to the cross member by a locking pin which is inserted into the lower part of the assembly and through the locking passageways. The support assembly includes a cushioned person support, which includes a stool configuration, a frontal support configuration, back support configuration and a creeper position.

18 Claims, 4 Drawing Sheets

66
24'
68
75
72
76
75
72
82
74
84
88
86
120
90
91
80
112
40
44
52
46
108
110
50
48
22
96
93
132
100°
134
14
130
130
95
136
28
134
134
30
26
96
42
92
106
32
18
12
132
106
20
106
7
136
16
38
36
34
106
7
12
94

98
136
16
100
98
104
102
100
12

102
104
102

MOVEABLE SUPPORT FRAME

BACKGROUND OF THE INVENTION

1. Field of the Invention

This invention relates to a moveable support frame for supporting a person. In particular, this invention relates to a support frame which is used to support a person working on cars, trucks and the like, to ease the strain on the person's back, and other parts of the body.

2. Background of the Invention

People, such as mechanics, often spend large amounts of time working in awkward positions on vehicles such as cars or trucks. For example, when working under the hood of a car, the mechanic often must bend over, creating a strain on the mechanic's back. When working overhead, such as when the car or truck is on an overhead hoist, strain is created in the neck and the back. When working on the side of the car, such as the wheels or brakes, the mechanic must squat or kneel which is uncomfortable and awkward. When working underneath such a vehicle on the ground, the mechanic must crawl under it and work in a confined space. In the past, there has been very few, if any, physical structures to assist the mechanic by providing an ergonomic support configuration for all situations.

BRIEF SUMMARY OF INVENTION

Therefore, it is an object of the present invention to provide a moveable support frame which is adaptable to provide ergonomic support to a mechanic who is working overhead, under the hood, on the side of and under a vehicle whether on the ground or raised on a hoist. Accordingly, in one of its aspects, the invention provides a moveable support frame for a person, said support frame comprising:

at least three ground engaging wheels, two opposed longitudinal members each being supported at either end by one of said wheels, at least one cross member affixed between said opposed longitudinal members adjacent one pair of opposed ends thereof, said cross member including a plurality of spaced locking means thereon, and an upright support post assembly supported on said cross member and releasably secured by said locking means, said upright support post assembly including an adjustable cushioned person support, and being positionable from side to side along said cross member.

DETAILED DESCRIPTION OF A PREFERRED EMBODIMENT

Figures 1, 5, 7:
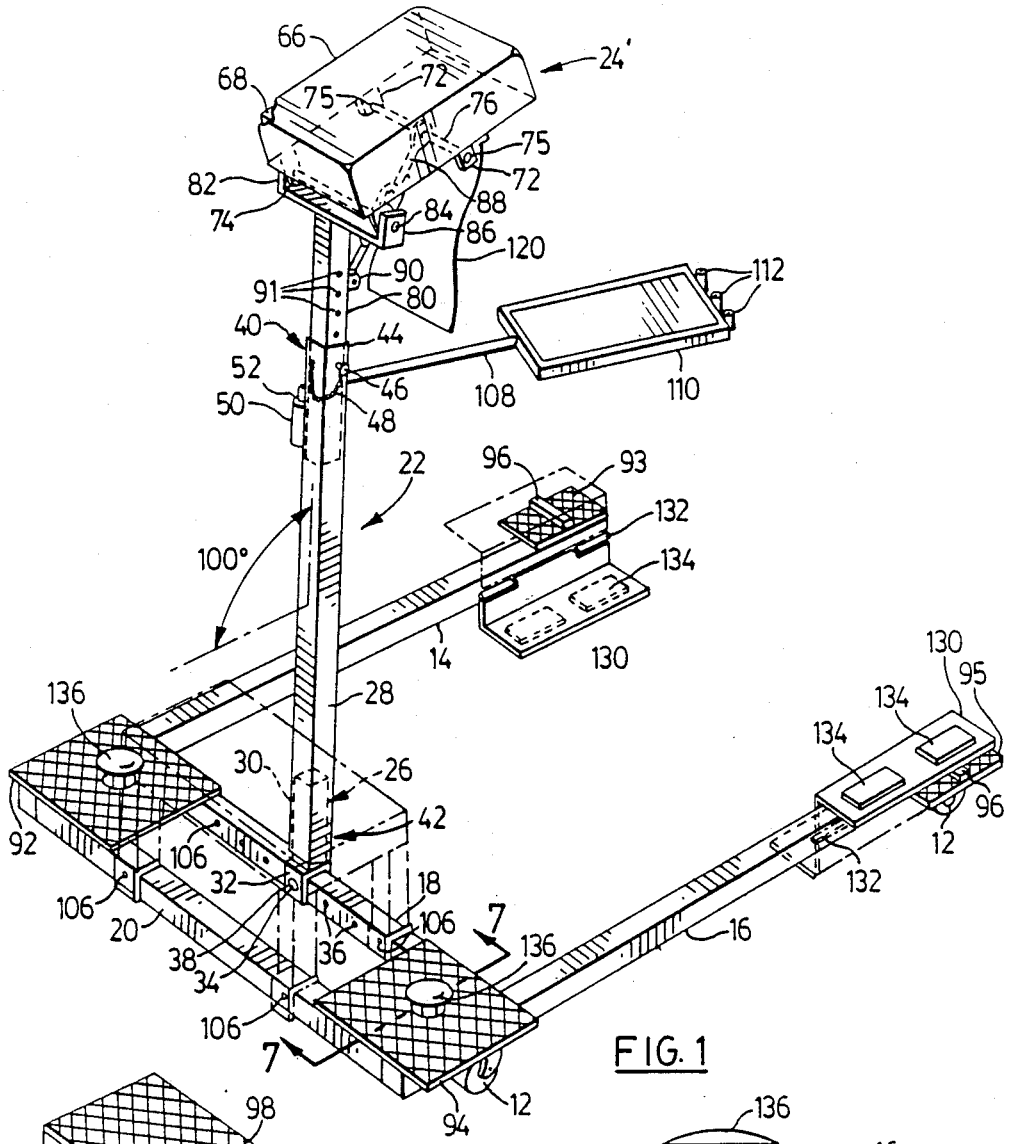
FIG. 1 is an isometric view from in front and to one side showing a moveable support frame according to the present invention.
FIG. 5 is a detail view of a removeable step, shown in position in ghost outline in FIG. 1.
FIG. 7 is a detailed view, in part section, showing a portion of the invention of FIG. 1.

In FIG. 1, a moveable support frame for supporting a person is indicated generally at 10. The support frame 10 is comprised of four ground engaging wheels 12, two opposed longitudinal members 14, 16, two cross members 18, 20 affixed between the longitudinal members 14, 16 and an upright support post assembly 22 supported on the cross member 18. The upright support post assembly 22 is adapted to support an adjustable cushioned person support, indicated generally at 24', and described more fully below.

The longitudinal members 14 and 16 are generally parallel. Two cross members 18 and 20 are shown, which intersect with the longitudinal members 14 and 16 at generally right angles. The cross members may be secured to the longitudinal members by any conventional means such as welding, or for knock down assemblies, can be bolted on. The cross members are located at one end of the opposed longitudinal members 14, and 16, and while two cross members are preferred for stability, it is also contemplated that the use of only one may be appropriate in certain circumstances. The wheels shown may either be self locking, or may be locked, for example, through the use of chocks. The large open space between the longitudinal members 14 and 16 is to allow the moveable support frame 10 to be easily positioned around obstacles, such as vehicle wheels.

The upright support post assembly 22 is comprised of a lower lockable section 26 and a height extension section 28. The lower lockable section 26 is made up of an upright post 30, which is attached to a saddle 32 by welding or the like. The upright post 30 is preferrably of square cross-section. The saddle 32 is in the form of an upside down U, and has opposed locking holes 34 located in each downward leg. The cross member 18 is preferrably of rectangular section, and has a plurality of locking passageways 36 therethrough. The saddle 32 is dimensioned to snuggly fit over the cross member 18. A locking pin 38 can be inserted through opposed locking holes 34 and locking passageways 36 to rigidly, but removeably, secure the lower lockable section 26 to the cross member 18. As is apparent from FIG. 1, the upright support post assembly 22 can be positioned from side to side as desired to position adjustable cushioned person support in the most advantageous position possible with respect to the vehicle being worked upon.

The height extension section 28 is in the form of a hollow rectangular tube, having open upper and lower ends 40, 42 respectively. In use, the upright post 30 of lower lockable section 26 is inserted into the open lower end 42 of the section 28. Adjacent the upper end 40 of the section 28 are located a plurality of opposed locking holes 44. Also, a second locking pin 46 may be secured, such as by a chain 48 to the upper end 40. A tubular element 50 is also shown, affixed to the outside of upper end 40 of section 28. The tubular element 50 has a generally vertically oriented central passageway 52 that is circular in cross section.

The open lower end 42 of section 28 is dimensioned to snuggly recieve the upright post 30 of lower lockable section 28. the upright post 30 extends into the open lower section 28 a sufficient degree to resist lateral forces applied to the upper end 40 of height extension section 28. As shown in FIG. 1, the open lower end 42 of section 28 abuts the saddle 32. the height extension section may be made to any convenient length, and it has been found that lengths of 9" and 30" provide good results.

Figure 3:
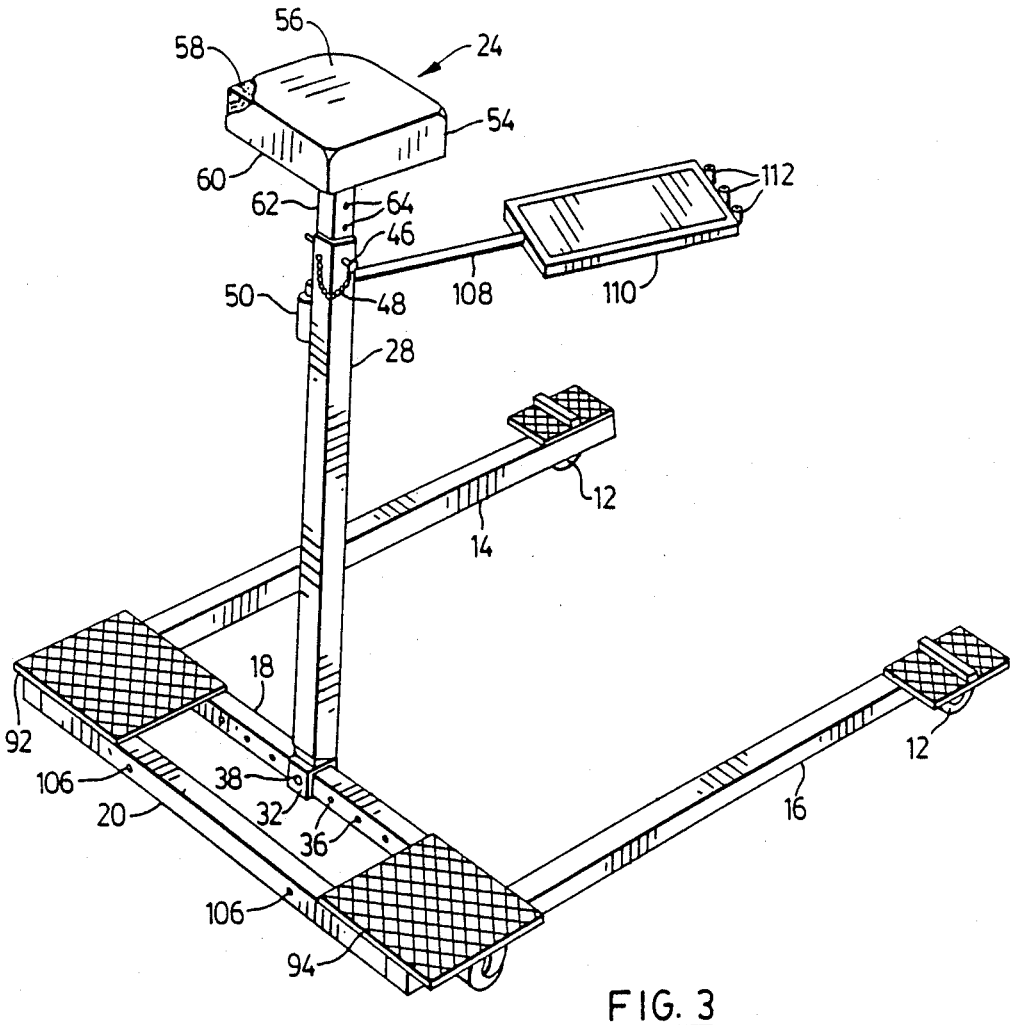
FIG. 3 is a view similar to FIGS. 1 and 2 showing a third aspect of the present invention.

Turning to FIG. 3, one embodiment of the adjustable cushioned person support 24 is shown which includes a generally horizontal support section 54. The support section 54 is comprised of a cover 56, a cushion 58 and a support plate 60. Protruding downwardly from the support plate 60 is a locking post 62, which is similar in size and function to upright post 30. The locking post 62 is retangular in section and is dimensioned to be snuggly received in open upper end 40 of the height extension section 28.

The cushioned person support 24 is height adjustable. The locking post 62 has a plurality of locking passageways 64 therethrough. It will now be appreciated that the second locking pin 46 may be inserted simultaneously through the opposed locking holes 44 and the locking passageways 64 to secure the cushioned person support at any desired height.

Referring again to FIG. 1, an embodiment of the present invention is shown which includes a slightly different adjustable cushioned person support, denoted as 24'. The support 24' consists of a cover 66, a support cushion 68 and a cushion support plate 70. The cushion support plate 70 has downwardly extending pairs of flanges 72, 74 with opposed holes 75 located in each flange. Two hinge rods 76, 78 are secured in the opposed holes between the pairs of flanges 72, 74. It will be appreciated by those skilled in the art that the flanges could be continous around the bottom of cushion support plate 70 rather than being in discrete pairs as shown, without affecting the present invention.

The cushioned person support 24' also includes a downwardly extending locking post 80, which has a generally Y-shaped appearance. The upper part of the Y is formed by two flanges 82, 84, which have opposed holes 86, and which are spaced to receive the pair of flanges 74 therebetween as shown. The hinge rod 78 is then inserted through the matching holes 76, 86 to rotatably attach the cushion support plate 70 to the downwardly extending locking post 80. The hinge rod 78 may be secured in any conventional manner, such as by placing nuts at the ends thereof.

The cushioned person support 24' also includes an axial support, shown as turnbuckle 88, which is secured between a bracket 90 on downwardly extending locking post 80 and the middle of the hinge rod 76. Thus, by adjusting the amount of extension of turnbuckle 88, the angle of the support cushion 68 can be varied.

The downwardly extending locking post 80 is constructed similary to locking post 62 as previously described. The post 80 has a plurality of locking passageways 91 and is generally of rectangular cross-section. The post 80 is snuggly received within open upper end 40 of the height extension section 28 and can be locked at any convenient height by the locking pin 46.

Referring now to FIG. 5 another feature of the present invention is shown. A step 98 is shown, having four downwardly depending legs 100. At the bottom of each leg 100 is a pair of downwardly extending flanges 102, which straddle the cross members 18 and 20. Each downward flange 102 has a locking hole 104 which mates with locking holes 106 in the cross members 18, 20 as shown. In this manner, the step 48 can be secured by means of locking pins (like locking pin 46) to the moveable frame 10.

The upper surface of the step 98 is of roughened texture to facilitate traction for a person standing thereon and working, for example, under the hood of a large truck. It has been found that checkered steel plate is suitable for this purpose.

As shown in FIG. 1, the tubular element 50, which is attached to height extension section 28, is used to house a swinging support rod 108. The support rod 108 is preferably circular in cross-section, and snuggle fits into the vertical central passageway 52 of the tubular element 50. The support rod 108 has a short vertical section, a 90° bend, and then a longer horizontal section. At the end of the horizontal section can be secured a tool tray 110, of conventional design. Along the edges of the tool tray 110 can be secured a number of shorter tubular elements 112, which can be used as handy places to store screw drivers, wrenches and the like.

Figures 4, 6:
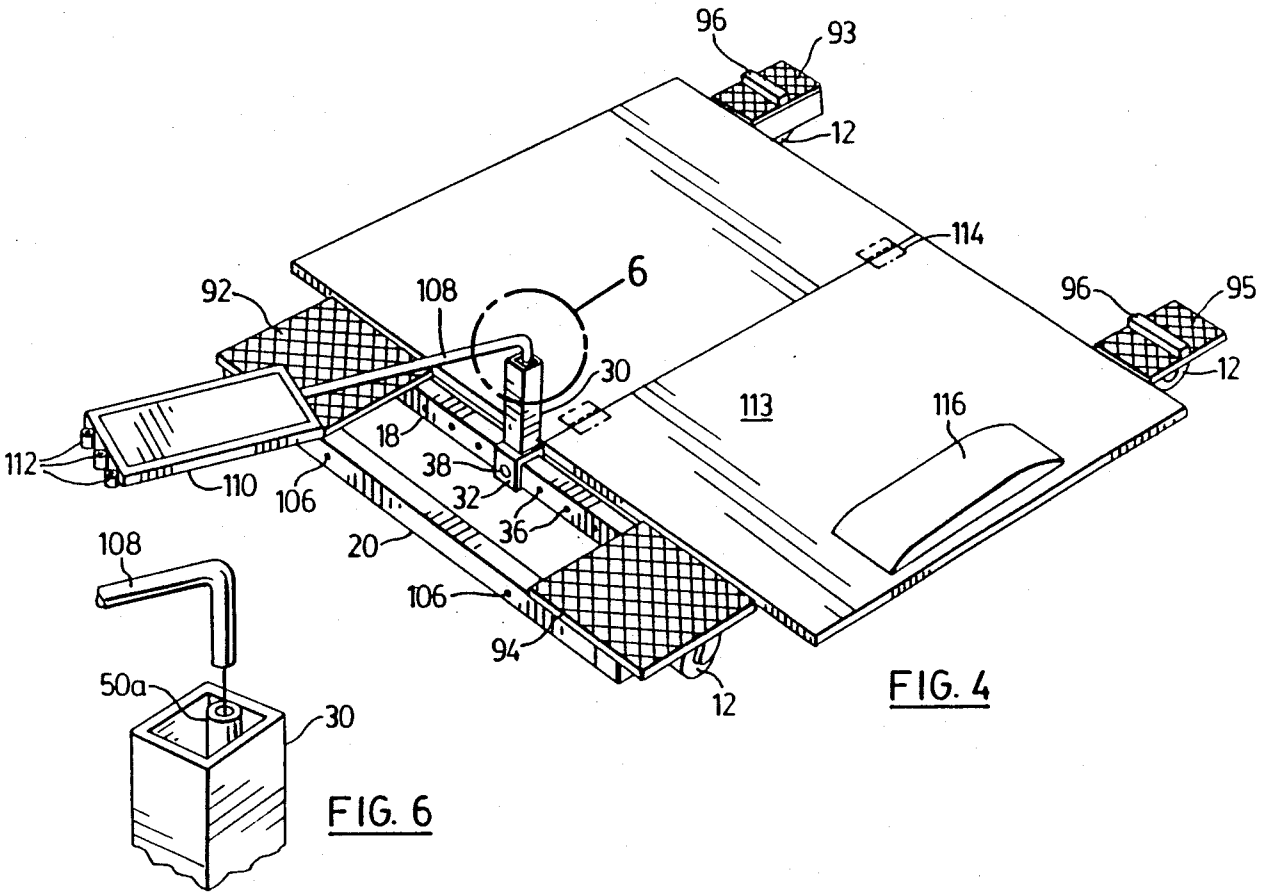
FIG. 4 is a view similar to FIGS. 1, 2 and 3, with the moveable support frame rotated 90° counter clockwise and showing a fourth aspect of the present invention.
FIG. 6 is a detail view of circle 6 shown in FIG. 4.

Referring now to FIG. 6, it can be seen that a second tubular element 50*a* has been secured into the hollow center of the upright post 30. In this manner, the tool tray 110 can be also used in association with the upright post 30, in the creeper position as shown in FIG. 4 and described below. The tubular element 50*a* can be secured by means of welding or the like.

The operation of the adjustable cushioned person support 24' can now be understood. As shown in FIG. 1, the support 24' has support cushion 68 facing an end of moveable frame 10 where the cross member 18, 20 are affixed. In this position, a person standing on the foot plates, identified as 92, 94, can rest the front of their mid section on the cushion 68, and comfortably work on subject matter below and on the opposite side of the cushion support 24' from the cushion 68. In this position, the person would typically be working under the hood of a car or truck that was on the ground.

Figure 2:
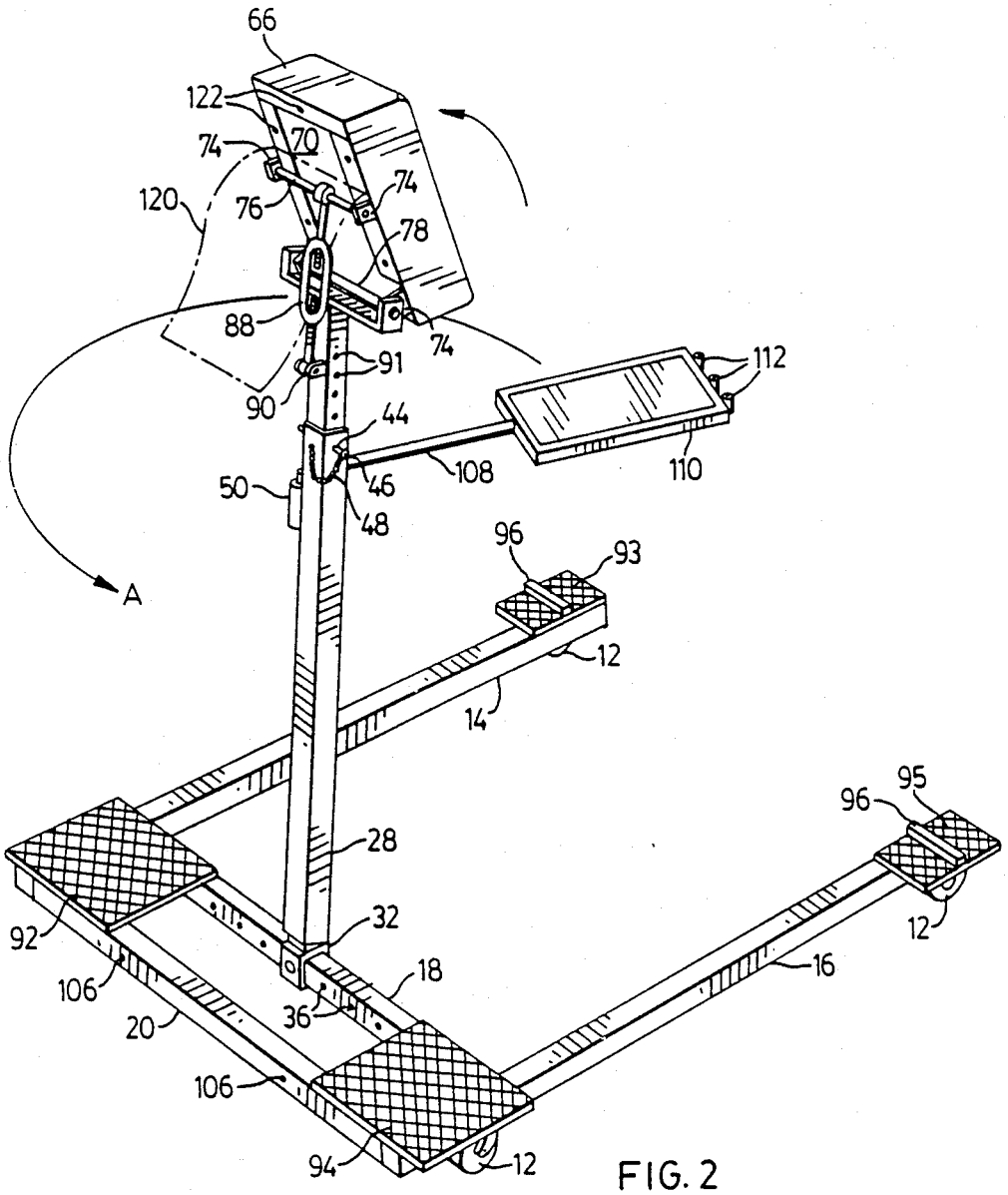
FIG. 2 is a view similar to FIG. 1, showing a second aspect of the present invention.

As shown in FIG. 2, the support 24' has the support cushion 68 facing in an opposite direction to that shown in FIG. 1. This can be easily accomplished by removing the locking pin 46, removing post 80, rotating the cushioned person support 24' by 180°, as indicated by arrow A, and reinserting post 80 into height extension section 28. In this position, the person would stand with their feet on the foot plates 93,95 but would instead rest their back on support cushion 68. Although the foot plates are preferably made of checkered steel plate, and therefore provide grip, foot supports 96 have been attached to each of foot plates 93, 95 for additional grip. In this position, the person would typically be working on the underside of a car or truck that was raised up on a hoist, and consequently required the person to work overhead and in front somewhat.

As shown in FIG. 3, an alternative mode is shown, which consists of a horizontal cushioned support 54 which is essentially a stool. This position would be used for either working under the hood, where the part to be worked on was close to the side of the car, or even directly on the side, for example on the wheels or brakes.

As shown in FIG. 4, the height extension section 28 has been removed, leaving only upright post 30. The swinging support rod 108 has been inserted in tubular element 50*a*, and the tool tray is supported close to the ground. Also shown is a removeable creeper platform 113 which consists of two halves hinged together as shown by hinges 114. The hinges 114 are located on the underside of the creeper platform 113, which supports a person in a prone position. A cushioned headrest 116 is also provided as shown. In the creeper position, a person can lie on their back to work underneath a car or truck resting on the ground. It will be noted that the creeper platform 113 fits snuggly between foot plates 92, 93, 94 and 95 and is retained in place thereby.

Referring back to FIGS. 1 and 2, a hanging fender protector 120 is also shown. The fender protector will prevent the turnbuckle 88 from scratching any vehicle being worked upon. The fender protector 120 can be made from any suitable material such as burlap cloth, or rubber mat. Also shown in FIG. 2 are snap fasteners 122, along the edge of cover 66. As the support frame 10 is intended for use by mechanics, in repair garages and the like, it is anticipated that the covers 56 and 66 will eventually become grease covered and dirty. By utilizing snap fasteners 122, the cover is easily and readily removable for cleaning.

Also shown in FIG. 1 the upright support post assembly 22 can be angled at 10° to the vertical, to place the adjusted cushioned person support 24 closer to the work area of the vehicle. All of the tubular elements are preferably made of steel, for durability, and are perferably of only two sizes, an external size (for the longitudinal members 14, 16, cross members 18, 20, height extension section 28 and legs 100) and an internal size (upright post 30 and locking posts 62 and 80).

As alternative to locking wheels or chalks, a brake mechanism may be used, as shown in FIG. 1. The brake mechanism, 130 consists of a brake member, 132 hingedly connected to frame. A rubber pad, 134 may also be provided to increase friction.

On the front, a spring loaded pad 136 may be provided to transmit the weight of the FIG. 7 person using frame directly to the floor, thereby preventing the frame from moving.

I claim:

1. A moveable support frame for a person, said support frame comprising:

at least three ground engaging wheels, two opposed longitudinal members each being supported at either end by one of said wheels, at least one cross member affixed between said opposed longitudinal members adjacent one pair of opposed ends thereof, said cross member including a plurality of laterally spaced locking means thereon, an upright support post assembly supported on said cross member and releasably secured along said cross member by said locking means, said upright support post assembly thereby being positionable from side to side along said cross member, and a cushioned person support comprising a support cushion supported by a cushion support plate, a downwardly protruding locking post and an axial support, said support plate being hingedly connected to an upper end of said locking post, said axial support extending between said support plate and said support post, and being of adjustable length to vary the inclination of the support plate, said locking post being supportable by said upright support post assembly in at least two opposed orientations, said cushioned person support having a first orientation angled and positioned to support a person's mid section and a second orientation angled and positioned to support a person's back.

2. The moveable support frame of claim 1 wherein said upright support post assembly includes a lower lockable section and a height extension section, said height extension section being generally tubular, and having open upper and lower ends, said lower lockable section being inserted into said open lower end, said upper end including a locking pin and a pair of opposed locking openings, said downwardly protruding locking post of said adjustable cushioned person support being inserted into said open upper end and locked therein by said locking pin.

3. The moveable support frame of claim 2 wherein said height extension section is 30" long.

4. The moveable support frame of claim 2 wherein said height extension section is 9" long.

5. The moveable support frame of claim 2 having two cross members disposed at right angles to said longitudinal members and being spaced apart.

6. The moveable support frame of claim 5 wherein said support frame further includes a step releasably secured across said cross members by removable locking pins inserted in mating locking holes in said step and said cross members.

7. The moveable support frame of claim 2 wherein said height extension section includes an upright tubular element attached to the outside thereof, and a swingable tool tray, said tool tray comprising a tool carry section and a supporting rod, said supporting rod being inserted into said tubular element to support said tool tray.

8. The moveable support frame of claim 7, wherein said tool tray includes a plurality of short upright tubular sections secured to one end for carrying tools and the like.

9. The moveable support frame of claim 2 further including a removeable creeper platform, secured on said frame and having a support cushion, said creeper platform supporting a person in a prone position for working underneath a vehicle.

10. The moveable support frame of claim 9 wherein at each end of said opposed longitudinal members is located a foot support plate, and said creeper platform snuggly fits between said foot support plates and rests on said longitudinal members between said foot support plates.

11. The moveable support frame of claim 2 wherein said upright support post is angled toward said end of said support frame distant from said cross member.

12. The moveable support frame of claim 11 wherein said upright support post is angled at about 10° to the vertical.

13. The moveable support frame of claim 2 wherein said adjustable cushioned person support includes a removable cover.

14. The moveable support frame of claims 1, 9 or 11 further including a brake mechanism releaseably engaging a surface upon which the support frame rests, said brake mechanism preventing said support frame from moving relative to said surface.

15. The moveable support frame of claim 14 wherein said brake mechanism comprises a brake element, hingedly attached to said opposed cross members and having a raised position, not in contact with said surface and having a lowered position in contact with surface.

16. The moveable support frame of claim 15 wherein elastomeric rubber is interposed between said brake mechanism and said surface, said rubber frictionally engaging said surface.

17. The moveable support frame of claim 14 wherein said brake mechanism comprises a pad, a plunger extending below said pad, and a spring interposed between said pad, and said support frame said plunger being biased by said spring to a raised position above said surface, said spring being compressible to allow said plunger to engage said surface.

18. The moveable support frame of claim 17 wherein elastomeric rubber is interposed between said brake mechanism and said surface, said rubber frictionally engaging said surface.

* * * * *